US006921455B1

(12) United States Patent
Nakano et al.

(10) Patent No.: US 6,921,455 B1
(45) Date of Patent: Jul. 26, 2005

(54) DEVICE FOR POLISHING OUTER PERIPHERAL EDGE OF SEMICONDUCTOR WAFER

(75) Inventors: Teruyuki Nakano, Hiroshima (JP); Yasuhiro Kozawa, Hiroshima (JP); Hitoshi Tambo, Hiroshima (JP)

(73) Assignee: Kabushiki Kaisha Ishii Hyoki, Hiroshima (JP)

( * ) Notice: Subject to any disclaimer, the term of this patent is extended or adjusted under 35 U.S.C. 154(b) by 421 days.

(21) Appl. No.: 09/856,402

(22) PCT Filed: Oct. 18, 2000

(86) PCT No.: PCT/JP00/07229

§ 371 (c)(1),
(2), (4) Date: Oct. 12, 2001

(87) PCT Pub. No.: WO01/28739

PCT Pub. Date: Apr. 26, 2001

(Under 37 CFR 1.47)

(30) Foreign Application Priority Data

Oct. 18, 1999 (JP) ..... 11-295847

(51) Int. Cl.[7] ..... C23F 1/00; H01L 21/306

(52) U.S. Cl. ..... 156/345.11; 156/345.12; 451/66

(58) Field of Search ..... 156/345.12, 345.13, 156/345.17, 345.18, 345.23; 451/63, 66, 44, 106, 93, 36, 40; 43/691, 692; 134/1.3, 135, 902

(56) References Cited

U.S. PATENT DOCUMENTS 4,426,151 A * 1/1984 Aguro et al. ..... 399/349
5,076,026 A * 12/1991 Mizuguchi et al. ..... 451/36
5,128,281 A * 7/1992 Dyer et al. ..... 438/693
6,280,294 B1 * 8/2001 Miyamoto ..... 451/34

* cited by examiner

*Primary Examiner*—P. Hassanzadeh
*Assistant Examiner*—Roberts Culbert
(74) *Attorney, Agent, or Firm*—J.C. Patents

(57) ABSTRACT

A polishing machine for a peripheral edge of a semiconductor wafer comprises a rotary mechanism 2 which rotates a stack 1 of semiconductor wafers 4 mounted thereon, and a polishing mechanism 3 which is arranged to be movable in the radial direction of the rotary mechanism 2 and polishes the peripheral edges of the rotating semiconductor wafers 4 by means of contactless polishing. Minute gaps s are formed between the rotary column 10 of the polishing mechanism 3 and the stack 1 of semiconductor wafers 4, and polishing solution is drawn into these minute gaps s. The peripheral edges of the semiconductor wafers 4 are polished by means of contactless polishing, using polishing abrasive particles included in polishing solution.

17 Claims, 8 Drawing Sheets

DEVICE FOR POLISHING OUTER PERIPHERAL EDGE OF SEMICONDUCTOR WAFER

BACKGROUND OF THE INVENTION

The present invention relates to a polishing machine for polishing the peripheral edge of a semiconductor wafer.

The peripheral edges of semiconductor wafers made from silicon and the like are chamfered, but in recent years, further polishing of the peripheral edge has come to be conducted in order to prevent particle formation on the peripheral edge, imperfections arising during handling, and the like. Edge processing methods are known, for example, a method for rotating a semiconductor wafer, and pressing a similarly rotating polishing pad thereto, while supplying polishing solution, as described in Japanese Patent Laid-Open Publication No. Hei. 11-104942, and a method for pressing a rotating polishing pad to a plurality of stacked semiconductor wafers, while supplying polishing solution thereto, as described in Japanese Patent Laid-Open Publication No. Hei. 05-182939.

Chamfering processes of the peripheral edge of semiconductor wafers have had the following problems, due to the fact that the chamfering radius is small and the chamfering corners are steeply inclined: even with a flexible polishing pad it is unfeasible to obtain uniform contact with the surface of the peripheral edge, making it difficult to obtain highly precise polishing, and because only a small part of the surface of the pad is in contact with the edge surface, for instance a point or a line, the polishing process is inefficient. Additionally, constant adjustments were required in order to maintain favorable polishing conditions, including changing the polishing pad at appropriate intervals.

SUMMARY OF THE INVENTION

In light of the above, it is an object of the present invention to provide a polishing machine for a peripheral edge of a semiconductor wafer, capable of highly precise, uniform, highly efficient, and stable polishing.

In order to achieve the above-mentioned object, the present invention provides a construction comprising: a rotary mechanism for holding a semiconductor wafer while rotating it in a prescribed direction; a rotary body which rotates relative to the semiconductor wafer while maintaining a prescribed gap from a periphery thereof, having a rotary axis which is set in the same direction as the rotary axis of the semiconductor wafer; a polishing solution channel for channeling the flow of polishing solution to said gap; and a polishing solution supply portion for supplying polishing solution to the polishing solution channel.

Additionally, in order to achieve the above-mentioned object, the present invention provides a construction comprising: a rotary mechanism for holding a semiconductor wafer while rotating it in a prescribed direction; a rotary body which rotates relative to the semiconductor wafer while maintaining a prescribed gap from a periphery thereof, having a rotary axis which is set in the same direction as the rotary axis of the semiconductor wafer; a polishing solution tank for immersing the rotary mechanism and rotary body in polishing solution; and a polishing solution circulation portion for circulating the polishing solution in and out of the polishing solution tank.

Since according to the present invention, contactless polishing is conducted by drawing polishing solution into the gap between the peripheral edge of semiconductor wafer and the rotary body, the peripheral edge of semiconductor wafer can be polished in a highly precise and uniform manner. Additionally, because the polishing pad of existing methods is not needed, polishing pad changing and adjustments are not necessary, allowing for a stable polishing process.

In the above-mentioned construction, the rotary mechanism holds one semiconductor wafer, or a plurality thereof in a stacked state. In the first case, the single semiconductor wafer held in the rotary mechanism is polished (the so-called single-wafer method), and in the second case, the plurality of semiconductor wafers held in the rotary mechanism are polished in turn (the so-called batch method).

Additionally, in the above-mentioned construction, a dynamic pressure generating grooves can be formed on the peripheral surface of the rotary body, facing the periphery of the semiconductor wafer. Because, according to this construction, the flow speed of polishing solution is increased through the dynamic pressure effect of the dynamic pressure generating grooves, the polishing efficiency is increased.

Additionally, in the above-mentioned construction, a magnet may be installed in the rotary body, and a magnetic polishing solution may be used as the polishing solution. Because, according to this construction, the magnetic polishing solution is confined by the magnet of the rotary body, the polishing efficiency is increased.

Additionally, in the above-mentioned construction, at least the peripheral surface of the rotary body facing the periphery of the semiconductor wafer may be formed of an elastic material with a hardness in the range of 7–40 Hs. The entire rotary body may be formed of an elastic material having a hardness of 7–40 Hs, and only the outer surface layer of the rotary body, including the peripheral surface, may be formed of an elastic material having a hardness of 7–40 Hs. The elastic material having a hardness of 7–40 Hs may be, for example, a rubber such as chloroprene rubber, or alternatively a synthetic resin formed into a porous (spongy) state by such means as expansion molding. The term "Hs" used here refers to hardness as measured by a JIS-standard Type A spring hardness tester (used to measure the hardness of rubber). This is widely used to express the hardness of a material in order to evaluate the elasticity of such elastic materials as rubber.

In the polishing machine of the present invention, the polishing efficiency and coarseness of the polished surface are influenced by such factors as polishing speed (the relative rotating speed of the semiconductor wafer and the rotary body), the flow speed and pressure of polishing solution in the above-mentioned gaps, the viscosity of the polishing solution, and the concentration and diameter of abrasive particles in the polishing solution. However, by forming at least the peripheral surface of the rotary body from an elastic material with a hardness of 7–40 Hs, variations in the values of the above-mentioned factors are absorbed by the appropriate elasticity of the rotary body peripheral surface, making it possible to constantly obtain a stable polishing efficiency and level of polished surface coarseness. Additionally, during the polishing process, the polishing speed may be changed (for example, polishing with a relatively high polishing speed for a prescribed length of time from the start of the polishing process, then polishing at a relatively lower polishing speed for the remainder of the polishing process) without changing the semiconductor wafer holding status, the polishing solution, or the like, enabling highly precise, highly efficient polishing.

DESCRIPTION OF THE PREFERRED EMBODIMENTS

The preferred embodiments of the current invention will be described in detail below, making reference to the drawings.

Figure 1:
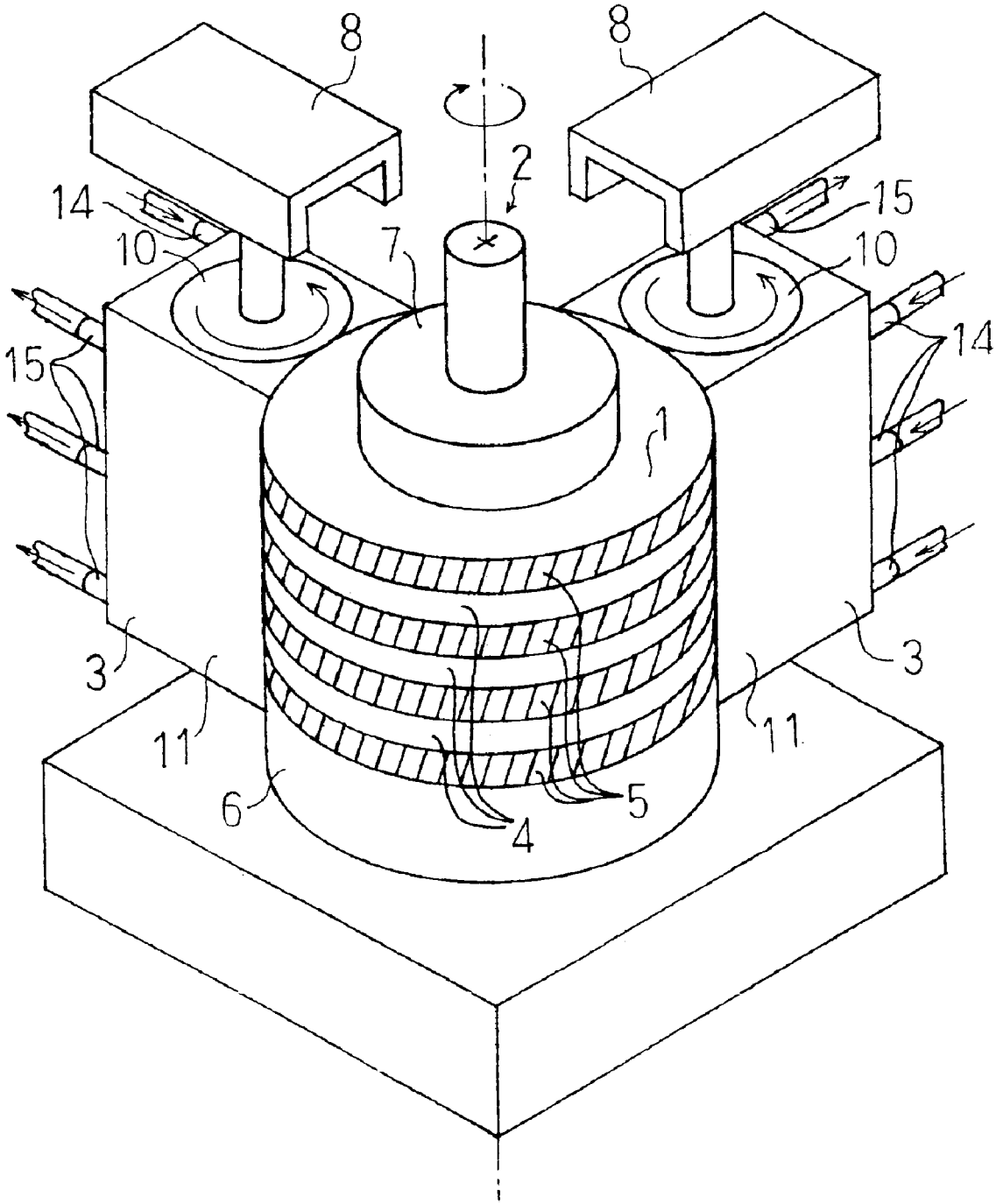
FIG. 1 is a perspective view of a polishing machine for a peripheral edge of a semiconductor wafer according to a first embodiment of the present invention.

As shown in FIG. 1, the polishing machine for a peripheral edge of a semiconductor wafer according to the first embodiment of the present invention comprises a rotary mechanism 2 on which is mounted and rotated a stack 1 of semiconductor wafers 4, and a polishing mechanism 3 which can be moved as desired along the radial direction of the rotary mechanism 2, and which polishes the peripheral edges of the rotating semiconductor wafers 4 via a contactless polishing process.

The peripheral edges of semiconductor wafers 4, having for example the shapes of circular plates, are chamfered as necessary, and notches (omitted from the drawing) are formed on the periphery at prescribed locations. The stack 1 of the semiconductor wafers 4 is aligned with the notches, and formed by placing spacers 5 between each semiconductor wafer 4. Note that the stack 1 of semiconductor wafers 4 is preferably provided with spacers 5 on the top and the bottom thereof, in order to keep from marking the surface of the wafers 4 when the stack 1 is locked into the rotary mechanism 2.

Rotary mechanism 2 comprises a turntable 6 on which is mounted the stack 1 of semiconductor wafers 4, and a locking piece 7 for pressing the stack 1 of semiconductor wafers 4 onto the turntable 6.

Polishing mechanism 3 has as the chief elements of its construction a housing 11, and a rotary body freely rotating and accommodated in the housing 11, for example a rotary column 10. This polishing mechanism 3 is mounted on a slide rail 8 installed in the radial direction of the rotary mechanism 2, and can move freely along the slide. Additionally, the elasticity means not shown in the drawing constantly presses the polishing mechanism 3 against the rotary mechanism 2 in the direction of the rotary mechanism 2 center through a prescribed level of elastic pressure.

Figure 2:
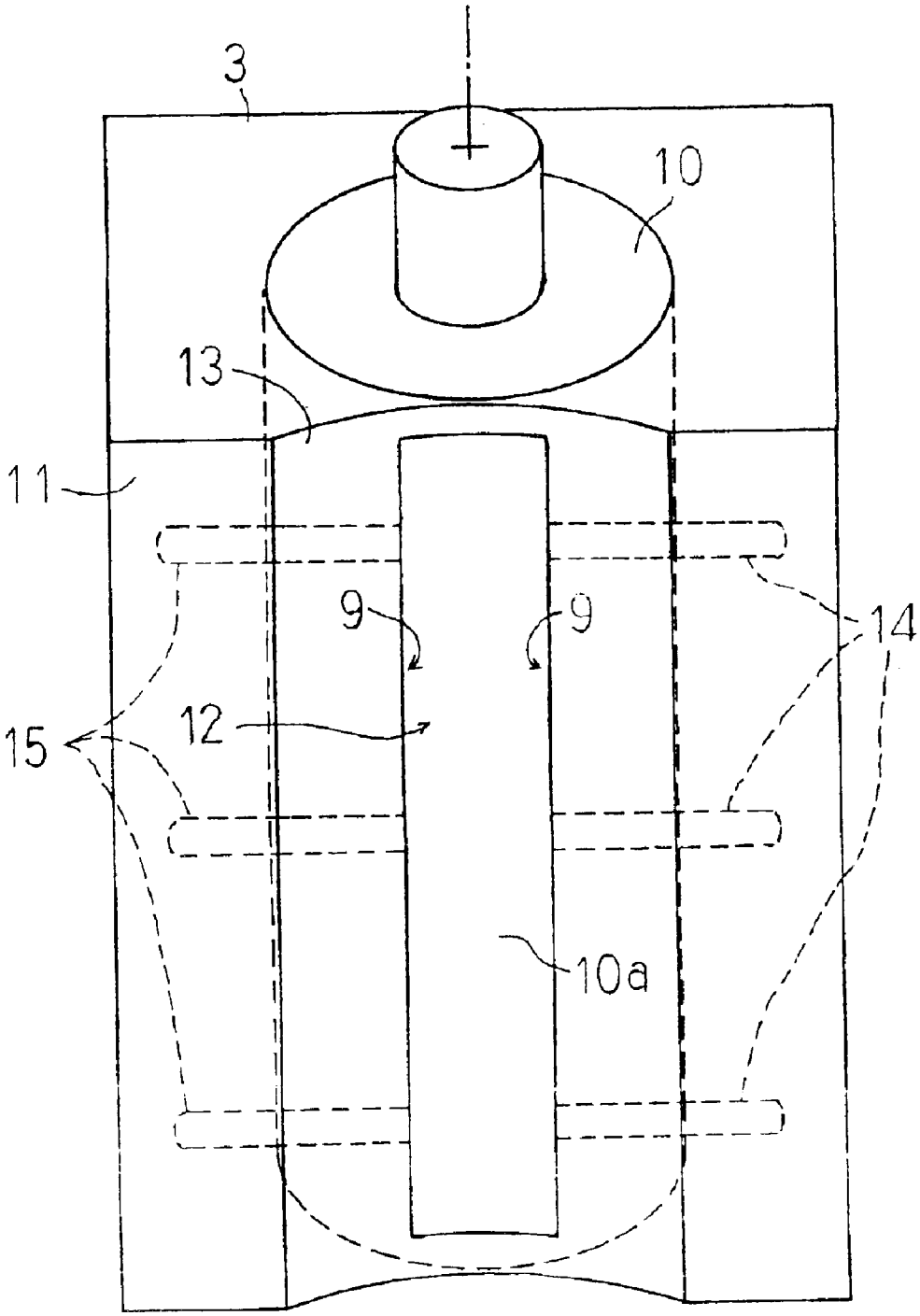
FIG. 2 shows the polishing surface of the polishing mechanism according to the first embodiment of the present invention.

As shown in FIG. 2, the housing 11 is provided with a contact surface 13, for example an approximately rectangular parallelepiped member on the side facing the rotary mechanism 2. The contact surface 13 contacts the periphery of the stack 1 along the contour of the outer surface thereof. The contact surface 13 has a curved inner side shape in order to conform to the outer shape of the stack 1 of semiconductor wafers 4. An aperture 12 is formed on the contact surface 13 in order to expose the rotary column 10 inside the housing 11. The periphery of the aperture 12 is sealed in order to keep the polishing solution from leaking.

Figure 3:
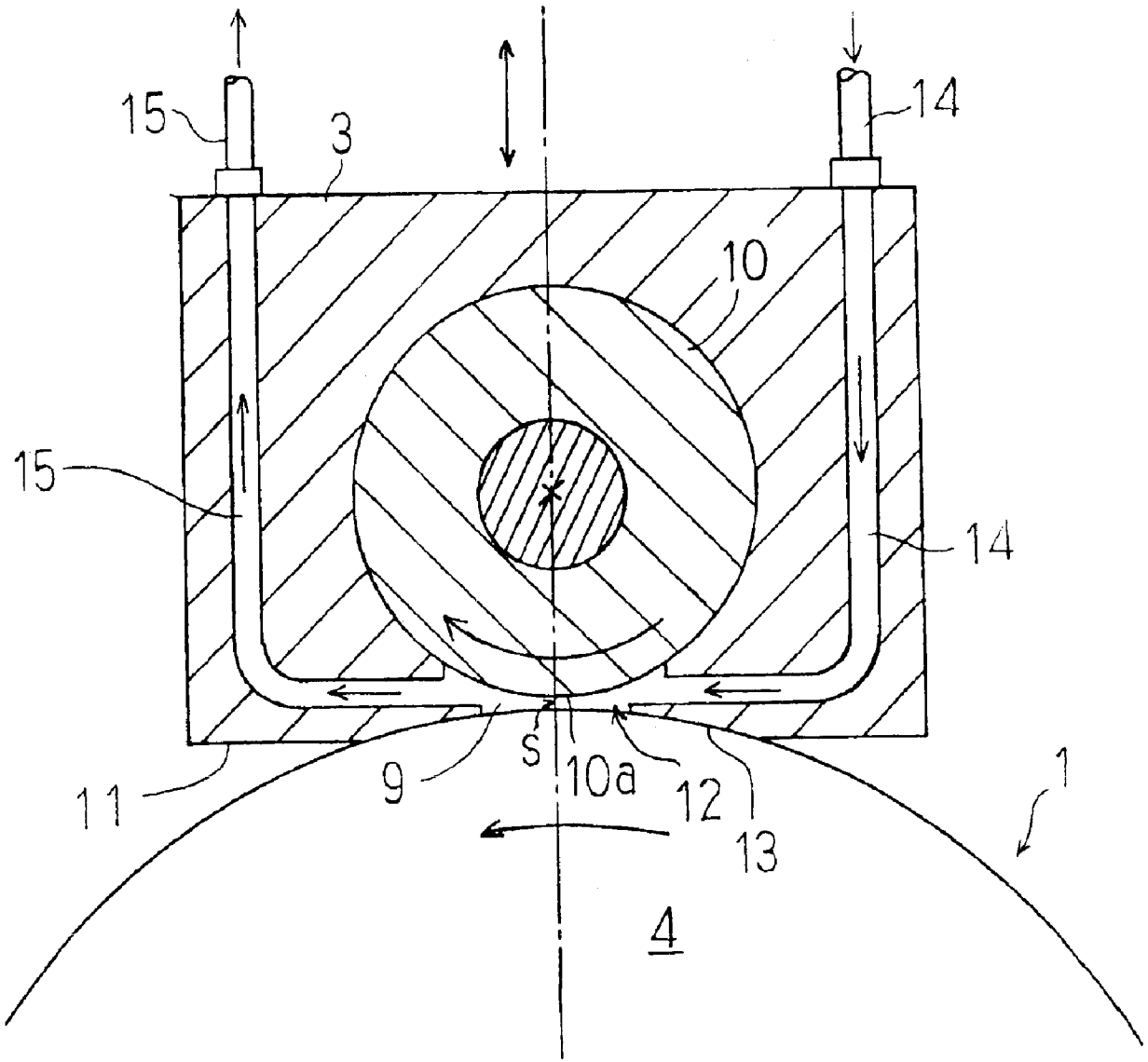
FIG. 3 shows the operational states of the polishing mechanism according to the first embodiment of the present invention.

The rotary column 10, for example a cylindrical member formed from metal or other materials having necessary rigidity, is accommodated within the housing 11 so that it can rotate freely, rotating on the vertical axis under the power of freely chosen rotary drive means. The outer surface 10*a* of the rotary column 10 is exposed at the aperture 12, and the polishing solution flow channel 9 narrows at the aperture 12. As shown in FIG. 3, the rotary column 10 faces the stack 1 at the aperture 12 via a minute gap s, and rotates in the opposite direction relative thereto.

As shown in FIG. 3, the housing 11 is equipped with the polishing solution flow channel 9 which channels polishing solution via the gap s of the aperture 12. The polishing solution flow channel 9 runs through the gap s of the aperture 12 at either side, and has a supply channel 14 and a drain channel 15 shown on the right and left sides of the drawing.

The polishing solution, for example an aqueous solution including polishing abrasive particles, is pressure-fed down the supply channel 14 using prescribed levels of pressure and heat, by means of an external pump and heat exchanger (omitted from the drawing). The polishing solution then flows from the supply channel 14 to the drain channel 15 by way of the gap s, forming in its totality the polishing solution flow channel 9.

A spring mounted on the slide rail 8 (omitted from the drawing) presses the polishing mechanism 3 against the stack 1 of semiconductor wafers 4. This absorbs differences in the diameters of the stack 1 and rotary column 10 and rotary vibration when the polishing machine for a peripheral edge is operated, ensuring contact between the contact surface 13 and stack 1, maintaining the appropriate size of the above-mentioned minute gap s, and preventing the leakage of polishing solution from the contact surface 13.

Then, because the polishing solution flow channel 9 narrows at the minute gap s, the flow speed and pressure of polishing solution passing therethrough increases, and the polishing abrasive particles collide with the peripheral edges of the semiconductor wafers 4 at a nearly flat angle. This enables the polishing mechanism 3 to polish the peripheral edges of the semiconductor wafers 4 with a high level of precision by destroying minute quantities thereof. Additionally, since this polishing machine polishes by causing polishing abrasive particles to collide with the edges during the flow of polishing solution, it is possible to uniformly polish the peripheral edges.

The above has described the first embodiment of the polishing machine for a peripheral edge, but this embodiment may be modified in a number of ways.

Figure 4:
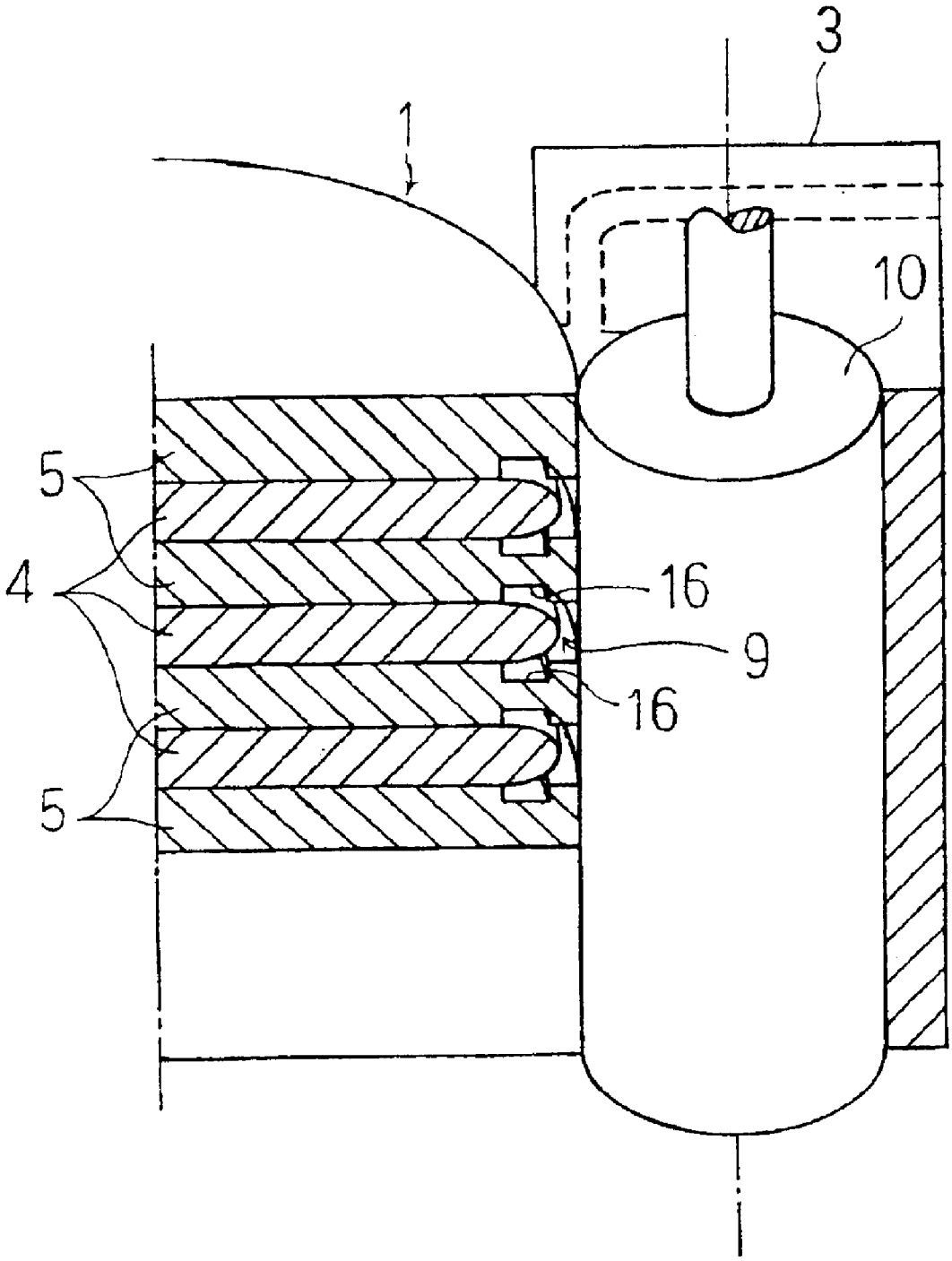
FIG. 4 shows an example of the polishing machine according to the first embodiment of the present invention, using differently shaped spacers.

For example, as shown in FIG. 4, the diameter of the spacer 5 may be slightly made larger than that of the semiconductor wafer 4, to form a prescribed minute gap s between the peripheral edges of the semiconductor wafers 4 and the rotary column 10 by causing the spacers 5 to contact the rotary column 10. Additionally, grooves 16 may be formed around the circumference of the spacers 5 in conformity with the edges of the chamfered portions of the semiconductor wafers 4, in order to uniformly draw polishing solution in around the entire edges of the semiconductor wafers 4. Additionally, in the above mentioned embodiment, the rotary axis of the rotary mechanism 2 which rotates the stack of semiconductor wafers 4 is set up along the vertical axis. However, the rotary axis of the rotary mechanism (the rotary axis of the semiconductor wafers 4) may be set up along the horizontal axis, and the related apparatuses may be arranged to correspond thereto.

Additionally, the polishing mechanism 3 does not only move along the radial direction of the stack 1 of semiconductor wafers 4, but is also provided with a mechanism which can move along the periphery of the stack 1 of semiconductor wafers 4. Moreover, the polishing solution may include surfactants and viscosity modifiers, and it is also permissible to modify the diameter of the polishing abrasive particles in a stepwise or continuous manner, in accordance with the process in question to perform sequentially coarse processing to finishing without removing a work. In addition, it is possible to use a polishing solution having mechanochemical polishing effects which includes chemically active solid particles or chemical solutions, or to use a polishing solution whose polishing abrasive particles themselves have mechanochemical polishing effects. It is also possible to form grooves on the surface of the rotary column 10, parallel to the rotary axis or in a spiral configuration, as dynamic pressure generating grooves in order to increase the flow speed of polishing solution at the gap between the rotary column 10 and semiconductor wafers 4, to form a textured surface, to form a hydrophilic membrane on the surface of the rotary column 10, or to construct the rotary column 10 from a porous material. Alternatively, it is possible to take a replica of the peripheral edge of a wafer using a softened polymer material, and use this as the rotary column 10.

Next, a polishing machine for a peripheral edge of a semiconductor wafer according to the second embodiment of the present invention will be described.

Figure 5:
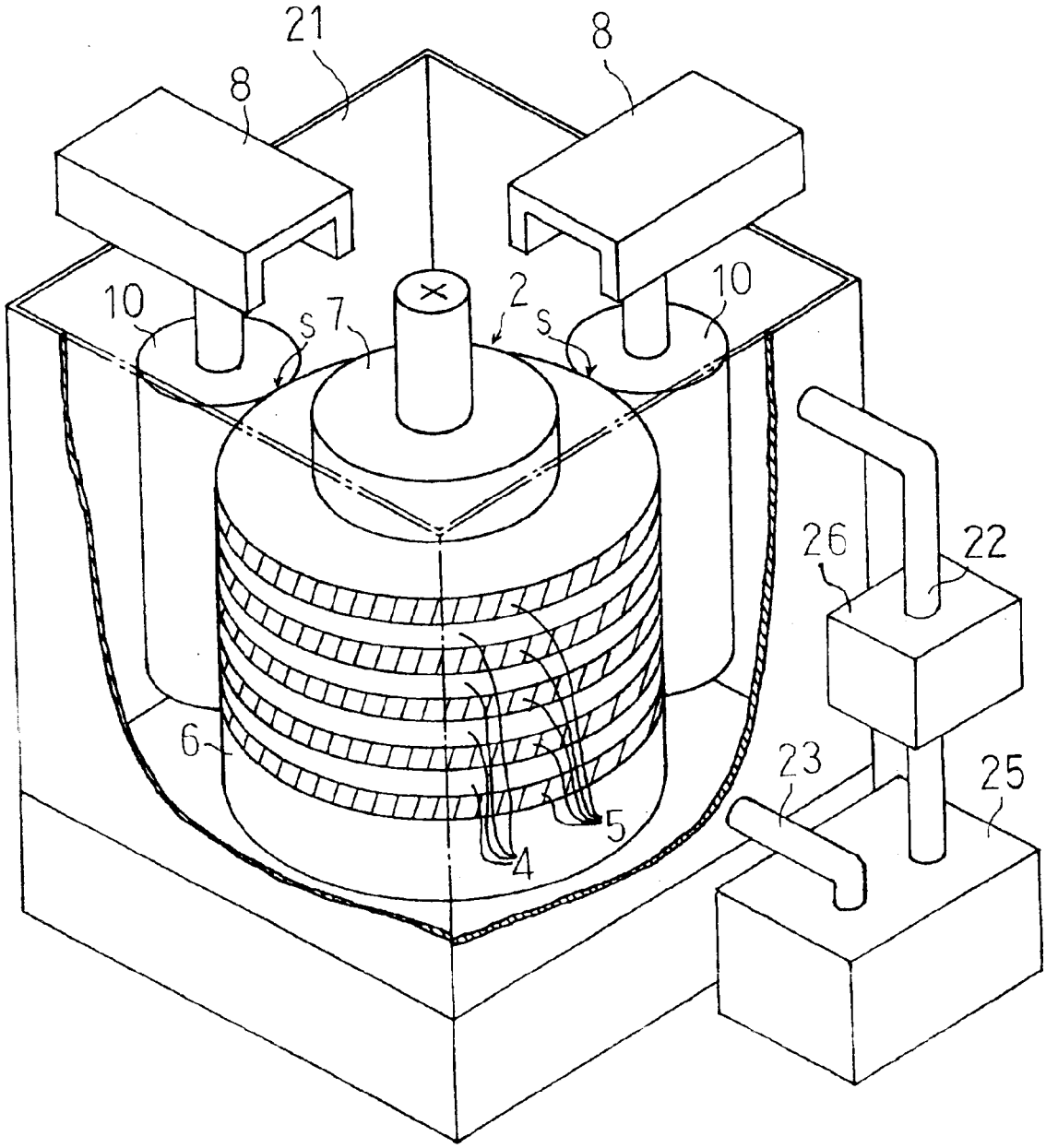
FIG. 5 is a perspective view of a polishing machine for a peripheral edge of a semiconductor wafer according to a second embodiment of the present invention.

As shown in FIG. 5, the polishing machine for a peripheral edge of a semiconductor wafer according to this embodiment is made up of the entire polishing machine for a peripheral edge of the first embodiment, immersed in a polishing solution tank 21 filled with polishing solution.

The polishing solution tank 21 is equipped with a polishing solution circulation apparatus 25. The polishing solution circulation apparatus 25 has two communicating pipes: a supply pipe 22 installed in the upper portion of the polishing solution tank 21, and a drain pipe 23 installed in the lower portion thereof, and circulates polishing solution in and out of the polishing solution tank 21. The polishing solution is collected from the lower portion of the polishing solution tank 21 by the polishing solution circulation apparatus 25, and after its temperature is regulated inside the heat exchanger 26, it is again supplied to the upper portion of the polishing solution tank 21.

The semiconductor wafers 4 are stacked, sandwiched by spacers 5 in the same manner as the first embodiment. In the approximate center of the polishing solution tank 21 is installed a rotary mechanism 2, which rotates the stack 1 of semiconductor wafers 4 mounted thereon. As in the first embodiment, the rotary mechanism 2 is equipped with a turntable 6 on which is mounted the stack 1 of semiconductor wafers 4, and a locking piece 7 which presses the stack 1 of semiconductor wafers 4 against the turntable 6, and fixes it in place. A slide rail 8 is installed in the radial direction of the rotary mechanism 2. The slide rail 8 axially supports a rotary column 10 which is freely movable. The rotary column 10 is constructed so as to rotate with the stack 1 of semiconductor wafers 4, mediated by a minute gap s.

In this polishing machine for a peripheral edge, the rotary mechanism 2 upon which is mounted the stack 1 of semiconductor wafers 4 and the rotary column 10 rotate in the opposite direction relative to each other, in a state in which polishing solution has penetrated therebetween. The polishing solution is drawn into the space between the relatively rotating stack 1 of semiconductor wafers 4 and rotary column 10 by means of viscosity. Fluid mechanics cause the speed of the polishing solution to increase as it is drawn into the minute gap s, due to the narrowing thereof. Then, when the polishing abrasive particles in the polishing solution pass through the minute gap s, they collide with the peripheral surfaces of the semiconductor wafers 4 at a nearly flat angle, polishing the peripheral edges thereof.

In other words, in the same manner as the polishing machine for a peripheral edge of the first embodiment, this polishing machine for a peripheral edge is able to polish the peripheral edges of the semiconductor wafers 4 with a high level of precision by destroying minute quantities thereof.

It is also permissible to form grooves on the surface of the rotary column 10 of this polishing machine for a peripheral edge, parallel with the rotary axis or in a spiral configuration, or process it to give it a textured surface. Additionally, it is possible to form a hydrophilic membrane on the surface of the rotary column 10, or to construct the rotary column 10 from a porous material. The shapes of the flow channel cover and/or polishing solution tank 21 may be changed in order to minimize the flow of polishing solution circulating therein.

Additionally, in the present embodiment the diameter of the spacer 5 may be slightly made larger than that of the semiconductor wafer 4 to form a prescribed minute gap s between the peripheries of the semiconductor wafers 4 and the periphery of the rotary column 10 by causing the spacers 5 to contact the rotary column 10.

Next, a polishing machine for a peripheral edge of a semiconductor wafer according to the third embodiment of the present invention will be described.

Figure 6:
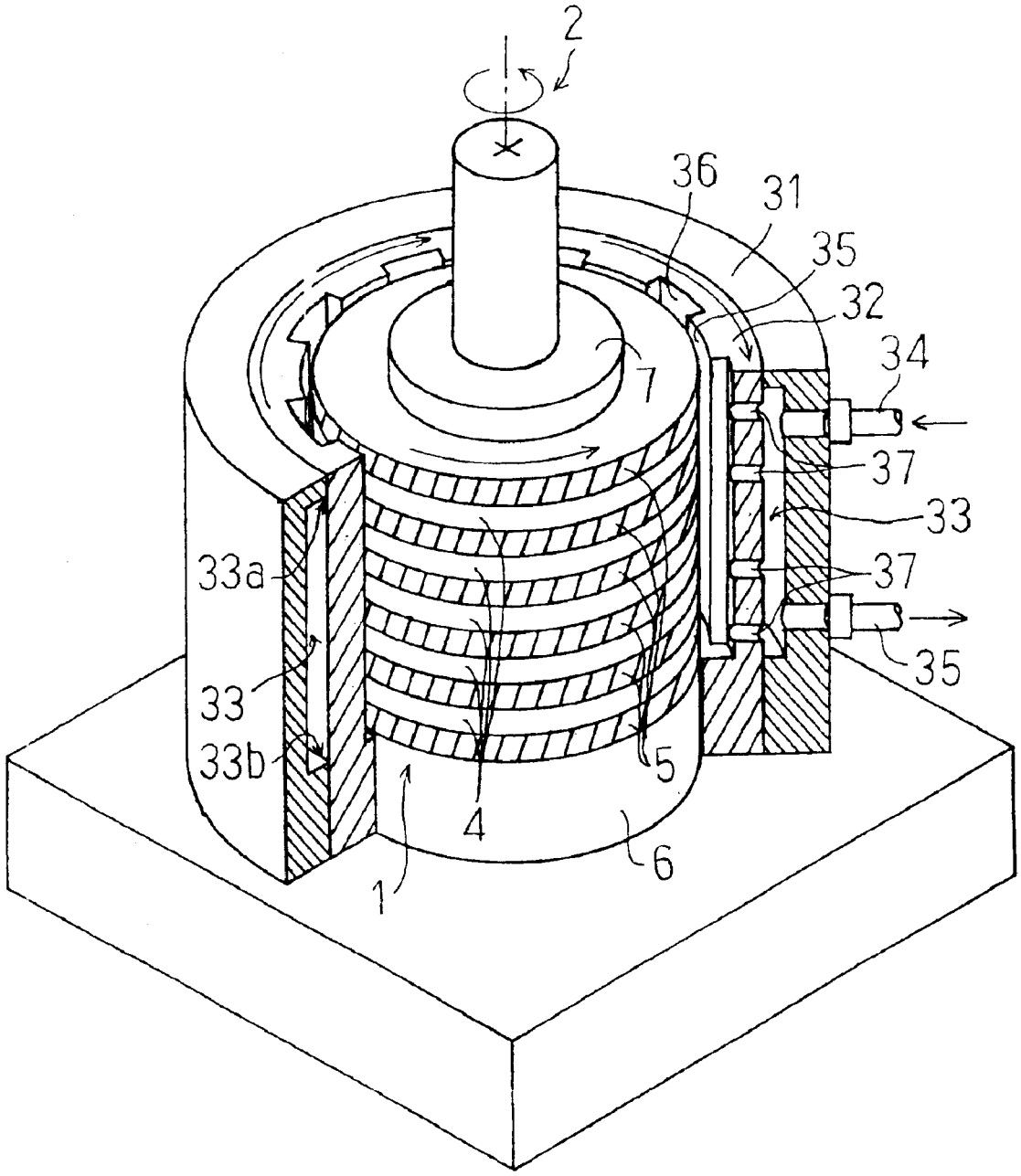
FIG. 6 is a perspective view of a polishing machine for a peripheral edge of a semiconductor wafer according to a third embodiment of the present invention.

As shown in FIG. 6, in this polishing machine for a peripheral edge, a rotary mechanism 2 upon which is mounted a stack 1 of semiconductor wafers 4, and an interior pipe body 32 mounted on the periphery of the stack 1 of semiconductor wafers 4, are accommodated inside an approximately cylindrical exterior pipe body 31 installed on the base thereof. Polishing solution is drawn into the minute gap between the stack 1 of semiconductor wafers 4 and interior pipe body 32, polishing the peripheral edges of the semiconductor wafers 4.

As in the first embodiment, the rotary mechanism 2 is equipped with a turntable 6 upon which is mounted the stack 1 of semiconductor wafers 4, and a locking piece 7 which presses the stack 1 of semiconductor wafers 4 onto the turntable 6, and fixes it thereto.

The exterior pipe body 31 serving as a polishing solution supply portion is affixed to the base so as to be on the same axis as the rotary mechanism 2. The exterior pipe body 31 is equipped with a storage portion 33 in order to create a space between it and the interior pipe body 32, and store polishing solution. In the interior of the exterior pipe body 31, the upper end 33*a* and lower end 33*b* are sealed in order to prevent leakage of the polishing solution from the storage portion 33. The side of the exterior pipe body 31 is equipped with a supply pipe 34 for supplying polishing solution, and a drain pipe 35 for draining the polishing solution. Polishing solution of a prescribed pressure is supplied to the storage portion 33 via the supply pipe 34 from a polishing solution supply apparatus (omitted from the drawing).

The interior pipe body 32, serving as a rotary column, is accommodated between the exterior pipe body 31 and the stack 1 of semiconductor wafers 4, and rotated by a rotary mechanism not shown in the drawing. The inner surface 35 of the interior pipe body 32 faces the peripheral surface of the stack 1 of semiconductor wafers 4 mediated by a minute gap. Vertically aligned dynamic pressure grooves 36 formed on the inner surface 35 of the interior pipe body 32 are distributed around the periphery at prescribed intervals. The dynamic pressure grooves 36 are equipped ith a plurality of polishing solution supply apertures 37 which are linked to the storage portion 33 of the exterior pipe body 31, in order to supply polishing solution to the interior of the interior pipe body 32.

This polishing machine for a peripheral edge rotates the stack 1 of semiconductor wafers 4 by means of the rotary mechanism 2 and rotates the interior pipe body 32 in the opposite direction relative to the stack 1 of semiconductor wafers 4, while supplying polishing solution at a prescribed pressure to the exterior pipe body 31. At this time, dynamic pressure generated between the stack 1 of semiconductor wafers 4 and interior pipe body 32 draws polishing solution between the inner surface 35 of the interior pipe body 32 and the stack 1 of semiconductor wafers 4 from the dynamic pressure grooves 36 of the interior pipe body 32.

The flow speed and pressure of the polishing solution drawn between the inner surface 35 of the interior pipe body 32 and the stack 1 of semiconductor wafers 4 is accelerated due to the narrowing of the flow channel therebetween. Additionally, due to the fact that the polishing solution flows around the peripheries of the semiconductor wafers 4, the polishing abrasive particles in the polishing solution pass collide with the peripheral surfaces of the semiconductor wafers 4 at a nearly flat angle, polishing the peripheral edges thereof. In other words, in the same manner as the polishing machine for a peripheral edge of the first embodiment, this polishing machine for a peripheral edge is able to polish the peripheral edges of the semiconductor wafers 4 with a high level of precision by destroying minute quantities thereof.

The dynamic pressure grooves 36 formed on the interior pipe body 32 may be wedge-shaped, in order to obtain a greater fluid-mechanical effect. Additionally, it is permissible to form a hydrophilic membrane on the surface of the interior pipe body 32, process it to give it a textured surface, or construct the interior pipe body 32 from a porous material. Moreover, as in the second embodiment, a construction in which the entire apparatus is immersed in polishing solution may be employed. Moreover, the rotary axis of the stack 1 of semiconductor wafers 4 may be given a horizontal construction and the related apparatuses may be arranged to correspond thereto. It is also permissible to employ a construction which locks the exterior pipe body 31 and interior pipe body 32 in place, and rotates the stack 1 of semiconductor wafers 4, and in this case, it is also permissible if the interior and exterior pipes do not completely enclose the wafers, or if they are notched.

It is also possible for the components adjacent to the semiconductor wafers 4 of the polishing machine for a peripheral edge of the above-mentioned embodiments 1–3 to be formed from high-purity silicon or high-purity quartz. Additionally, the rotary column 10 and/or interior pipe body 32 may be made of, for example, polyurethane.

With the above-mentioned construction, the components of the polyurethane rotary column 10 or interior pipe body 32 that are adjacent to the stack 1 of semiconductor wafers 4 are deformed in conformity with the peripheral shape of the stack 1, and form a minute gap s together with the semiconductor wafers 4 within the polishing solution. Then, polishing solution is drawn between it and the stack 1 of semiconductor wafers 4, generating a high-speed fluid bearing-type flow. At this time, the polishing abrasive particles included in the fluid collide with the surface of the semiconductor wafers 4, achieving high-precision polishing by destroying minute quantities thereof.

For example, in an embodiment in which the rotary column 10 is made of polyurethane, if the rotary column 10 is pressed against the periphery of the stack 1 of semiconductor wafers 4, then it is easy to establish a minute gap s, since the shape thereof is freely changed to conform to the shape of the periphery of the stack 1 of semiconductor wafers 4 and a minute gap is formed between it and the semiconductor wafers 4.

Alternatively, it is possible to form the rotary column 10 in its entirety, or the surface portion including the peripheral surface 10*a* thereof, of a rubber such as chloroprene rubber, or alternatively a synthetic resin formed into a porous (spongy) state, using an elastic material with a hardness of 7–40 Hs. Even if there are fluctuations in polishing speed (the relative rotary speed of the semiconductor wafer and rotary body), the flow speed and pressure of the polishing solution inside the minute gap s, viscosity of the polishing solution, and the concentration and diameters of the abrasive particles included in the polishing solution, it is possible to constantly obtain a stable polishing efficiency and polishing surface grain, since these fluctuations are absorbed by the appropriate elasticity of the peripheral surface 10*a* of the rotary column 10. Additionally, during the polishing process, the polishing speed may be changed (for example, polishing with a relatively high polishing speed for a prescribed length of time from the start of the polishing process, then polishing at a relatively lower polishing speed for the remainder of the polishing process) without changing the semiconductor wafer holding status, the polishing solution, or the like, enabling highly precise, highly efficient polishing.

Next, a polishing machine for a peripheral edge of a semiconductor wafer according to a fourth embodiment of the present invention will be described.

Figure 7:
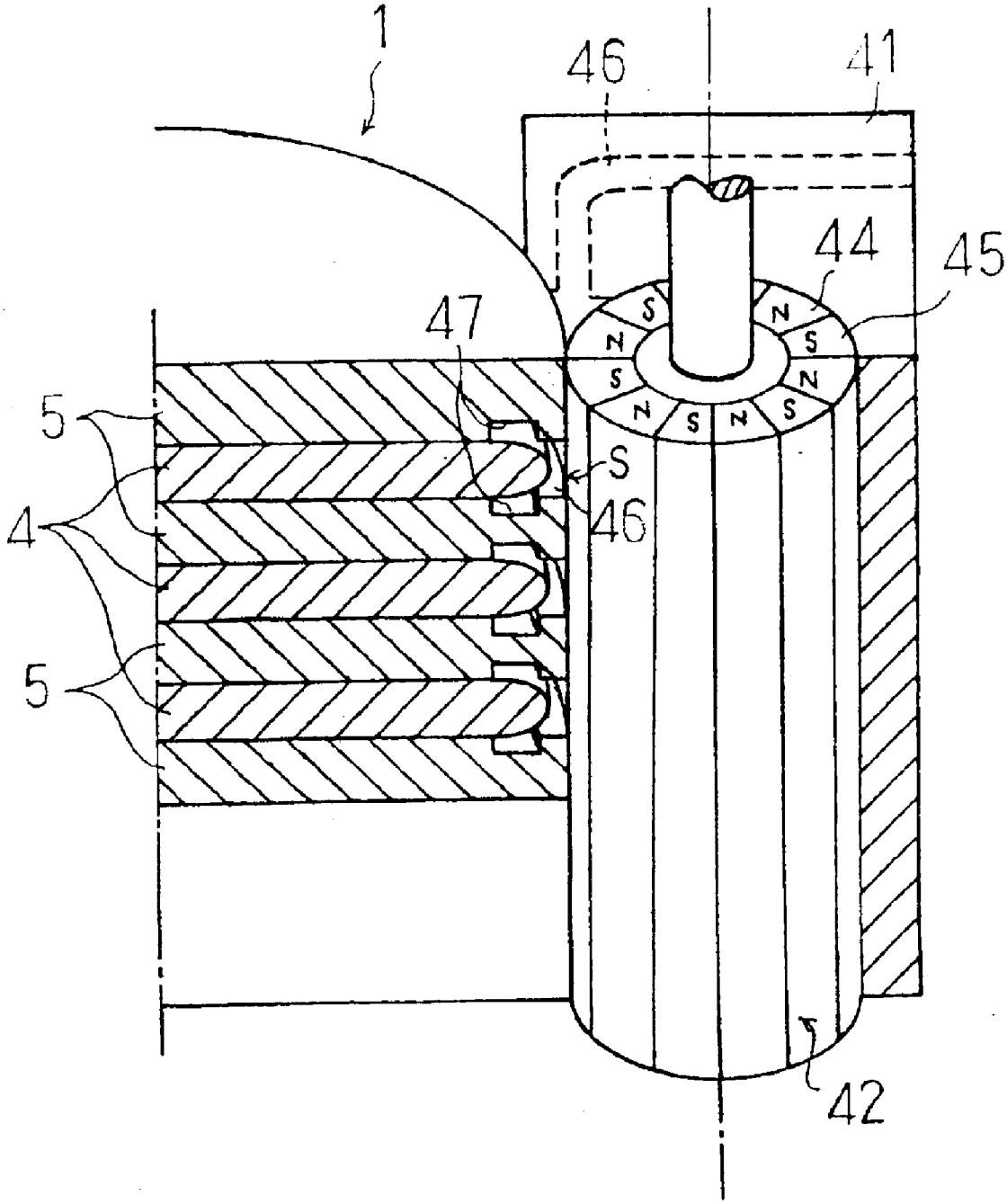
FIG. 7 shows a magnetic polishing mechanism of a polishing machine for a peripheral edge of a semiconductor wafer according to a fourth embodiment of the present invention.

AS shown in FIG. 7, although the basic construction of the polishing machine for a peripheral edge of this embodiment is the same as that of the polishing machine for a peripheral edge of the first embodiment, unlike the polishing machine for a peripheral edge of the first embodiment, this embodiment is equipped with a magnetic polishing mechanism 41 having n-polar 44 and s-polar 45 magnets arrayed in alternation around the periphery of the outer surface of the rotary column 42, and using magnetic polishing solution including polishing abrasive particles in the magnetic fluid.

Since magnets 44 and 45 are installed in the outer surface of the rotary column 42, the magnetically charged magnetic polishing solution is drawn by the magnetic fields of the magnets 44 and 45 of the rotary column 42. Then, by rotating the stack 1 of semiconductor wafers 4 and the rotary column 42 in opposite directions relative to each other, the magnetic polishing solution is drawn into the minute gap s of the polishing solution flow channel 46 along the surface of the rotary column 42. This enables high-precision polishing of the peripheral edges of the semiconductor wafers 4 by destroying minute quantities thereof, in the same manner as the polishing machine for a peripheral edge of the first embodiment.

This polishing mechanism 41 may be constructed in such a manner that it does not only move in the radial direction of the stack 1 of semiconductor wafers 4, but also moves in the peripheral direction along the circular periphery thereof. Moreover, the magnetic polishing solution may contain surfactants and viscosity modifiers. In addition, a polishing solution having mechanochemical polishing effects which includes chemically active solid particles or chemical solutions, or a polishing solution whose polishing abrasive particles themselves have mechanochemical polishing effects may be used. It is also possible to form grooves on the surface of the rotary column 42, parallel to the axis or in a spiral configuration, as dynamic pressure grooves in order to increase the flow speed of magnetic polishing solution through the minute gap s by means of a fluid-mechanical effect. It is also possible to form a hydrophilic membrane on the surface of the rotary column 42.

In the embodiment shown in FIG. 7, the outer diameter of the spacer 5 is slightly made larger than that of the semiconductor wafer 4 to contact the rotary column 42 with the peripheries of the spacers 5, forming a minute gap between the rotary column 42 and semiconductor wafers 4. Additionally, grooves 47 are provided in the peripheral direction of the spacers 5, so that the magnetic polishing solution flows uniformly along the edges of the semiconductor wafers 4.

Note that in FIG. 7, although the rotary axis of the rotary mechanism is set up along the vertical axis, the rotary axis of the rotary mechanism may be set along the horizontal axis, and the related apparatuses may be arranged to correspond thereto. Moreover, it is also possible to employ a construction immersing the entire apparatus in magnetic polishing solution, in the same manner as the second embodiment.

Next, a polishing machine for a peripheral edge of a semiconductor wafer according to the fifth embodiment of the present invention will be described.

Figure 8:
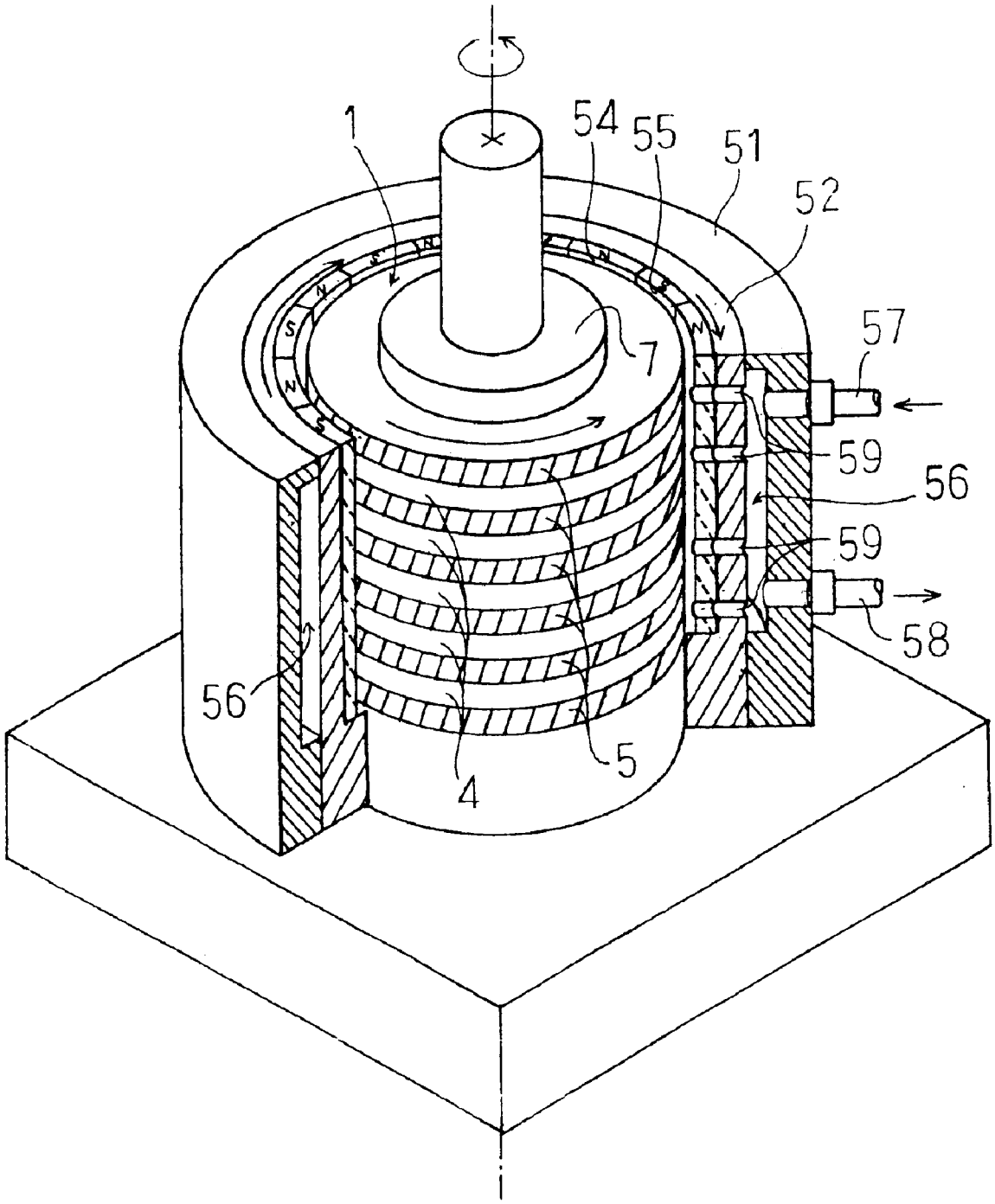
FIG. 8 is a perspective view of a polishing machine for a peripheral edge of a semiconductor wafer according to a fifth embodiment of the present invention.

As shown in FIG. 8, in the polishing machine for a peripheral edge of this embodiment, a rotary mechanism 2 upon which is mounted a stack 1 of semiconductor wafers 4 and an interior pipe body 52 surrounding the stack 1 of semiconductor wafers 4 are accommodated within a generally cylindrical exterior pipe body 51 installed on the base thereof. Note, however, that in the present embodiment, an interior pipe body 52 is used which has n-polar 54 and s-polar 55 magnets arrayed in alternation around the periphery of the inner surface thereof, and a magnetic polishing solution is used including polishing abrasive particles in magnetic fluid.

The exterior pipe body 51, in the same manner as the exterior pipe body 31 according to the third embodiment, is equipped with an internal storage portion 56, a supply pipe 57 that supplies magnetic polishing solution at a prescribed pressure to a storage portion 56 from a magnetic polishing solution supply apparatus not shown in the drawing, and a drain pipe 58 that drains magnetic polishing solution from the storage portion 56.

This polishing machine for a peripheral edge rotates a stack 1 of semiconductor wafers 4 by means of a rotary mechanism 2, and rotates an interior pipe body 52 by means of the rotary mechanism 2 not shown in the drawing in the direction opposite to that of the stack 1 of semiconductor wafers 4, while supplying the magnetic polishing solution with a predetermined pressure into the exterior pipe body 51.

Magnetic polishing solution is supplied to the gap between the interior pipe body 52 and the stack 1 of semiconductor wafers 4 from a plurality of supply apertures 59 in the interior pipe body 52. Then, the magnetic polishing solution is drawn by the magnets 54 and 55 installed in the inner surface of the interior pipe body 52, and drawn into the gap between the interior pipe body 52 and stack 1 of semiconductor wafers 4 which are rotating opposite relative one another.

At this time, since the polishing abrasive particles in the magnetic polishing solution collide with the peripheral edges of the semiconductor wafers 4 at a nearly flat angle, it is possible to conduct high-precision polishing of the peripheral edges of the semiconductor wafers 4 by means of a minute-quantity destruction effect.

Note that in order to increase the speed of the magnetic polishing solution flow at the gap between the interior pipe body 52 and the semiconductor wafers 4 through a fluid-mechanical effect, it is possible to form grooves on the inner surface of the interior pipe body 52 parallel to the rotary axis thereof or in a spiral configuration, as dynamic pressure grooves, and it is also possible to make these grooves wedge-shaped in order to obtain a greater fluid-mechanical effect.

The above has described embodiments of the present invention, but the present invention is not limited to these embodiments. For example, in the stack of semiconductor wafers, wafers are stacked sandwiched by spacers, but the form is not limited to a stack of semiconductor wafers. Additionally, the constructions of embodiments 1 to 6 may be combined as desired. Furthermore, although in the embodiments described above a plurality of semiconductor wafers are simultaneously polished using the so-called batch method, it is also possible to use a construction in which the rotary mechanism holds and rotates a single semiconductor wafer, polishing a single semiconductor wafer at a time (the so-called single-wafer method).

What is claimed is:

1. A polishing machine for a peripheral edge of a semiconductor wafer, said machine comprising:

a rotary mechanism for holding a semiconductor wafer while rotating it in a prescribed direction;

a rotary body which rotates relative to the semiconductor wafer while maintaining a prescribed gap from a periphery of said semiconductor wafer, having a rotary axis which is set in the same direction as the rotary axis of said semiconductor wafer, so that the rotary body and the semiconductor wafer are not in contact with each other during a complete polishing process;

a polishing solution channel for channeling the flow of polishing solution to said gap; and a polishing solution supply portion for supplying the polishing solution to said polishing solution channel;

wherein said polishing solution is drawn into said gap between the peripheral edge of said semiconductor wafer and said rotary body, and polishing abrasive particles in said polishing solution collide with the peripheral edge of said semiconductor wafer to conduct non-contact polishing of the peripheral edge of said semiconductor wafer.

2. A polishing machine for a peripheral edge of a semiconductor wafer, said machine comprising:

a rotary mechanism for holding a semiconductor wafer while rotating it in a prescribed direction;

a rotary body which rotates relative to the semiconductor wafer while maintaining a prescribed gap from a periphery of said semiconductor wafer, having a rotary axis which is set in the same direction as the rotary axis of said semiconductor wafer, so that the rotary body and the semiconductor wafer are not in contact with each other during a complete polishing process;

a polishing solution tank for immersing said rotary mechanism and said rotary body in polishing solution; and a polishing solution circulation portion for circulating the polishing solution in and out of said polishing solution tank;

wherein said polishing solution is drawn into said gap between the peripheral edge of said semiconductor wafer and said rotary body, and polishing abrasive particles in said polishing solution collide with the peripheral edge of said semiconductor wafer to conduct non-contact polishing of the peripheral edge of said semiconductor wafer.

3. The polishing machine for a peripheral edge of a semiconductor wafer according to claim 1, wherein said rotary mechanism holds a plurality of semiconductor wafers in a stacked state.

4. The polishing machine for a peripheral edge of a semiconductor wafer according to claim 1, wherein dynamic pressure generating grooves are formed on the peripheral surface of said rotary body facing the periphery of said semiconductor wafer.

5. The polishing machine for a peripheral edge of a semiconductor wafer according to claim 1, wherein a magnet is installed in said rotary body and a magnetic polishing solution is used as said polishing solution.

6. The polishing machine for a peripheral edge of a semiconductor wafer according to claim 1, wherein at least the peripheral surface of said rotary body facing the periphery of said semiconductor wafer is formed of an elastic material with a hardness in the range of 7–40 Hs.

7. The polishing machine for a peripheral edge of a semiconductor wafer according to claim 2, wherein said rotary mechanism holds a plurality of semiconductor wafers in a stacked state.

8. The polishing machine for a peripheral edge of a semiconductor wafer according to claim 2, wherein dynamic pressure generating grooves are formed on the peripheral surface of said rotary body facing the periphery of said semiconductor wafer.

9. The polishing machine for a peripheral edge of a semiconductor wafer according to claim 2, wherein a magnet is installed in said rotary body and a magnetic polishing solution is used as said polishing solution.

10. The polishing machine for a peripheral edge of a semiconductor wafer according to claim 2, wherein at least the peripheral surface of said rotary body facing the periphery of said semiconductor wafer is formed of an elastic material with a hardness in the range of 7–40 Hs.

11. The polishing machine for a peripheral edge of a semiconductor wafer according to claim 1, wherein the rotary mechanism holds a plurality of semiconductor wafers forming a cylindrical shaped stack, the rotary body is accommodated in a housing, the housing has a contact surface conforming to a circumference of the cylindrical shaped stack of the semiconductor wafers, an aperture is formed in the contact surface to expose the semiconductor wafers to the rotary body.

12. The polishing machine for a peripheral edge of a semiconductor wafer according to claim 11, wherein the contact surface of the housing is in sealed contact with the circumference of the cylindrical shaped stack of the semiconductor wafers.

13. The polishing machine for a peripheral edge of a semiconductor wafer according to claim 11, wherein the cylindrical shaped stack comprises disc shaped spacers to separate each of the semiconductor wafers, the diameter of the disc shaped spacers is larger than the diameter of the semiconductor wafers.

14. The polishing machine for a peripheral edge of a semiconductor wafer according to claim 1, wherein the rotary mechanism holds a plurality of semiconductor wafers forming a cylindrical shaped stack, the rotary body has a hollow cylindrical shape for accommodating the cylindrical shaped stack of the semiconductor wafers, said prescribed gap is formed between an inner surface of the hollow cylindrical shaped rotary body and a circumference of the cylindrical shaped stack of the semiconductor wafers.

15. The polishing machine for a peripheral edge of a semiconductor wafer according to claim 14, wherein a dynamic pressure groove is formed on the inner surface of the hollow cylindrical shaped rotary body, extending in the direction of the rotary axis of the hollow cylindrical shaped rotary body.

16. The polishing machine for a peripheral edge of a semiconductor wafer according to claim 14, further comprising a fixed hollow cylindrical body for accommodating the hollow cylindrical shaped rotary body, a passage is formed between an outer surface of the hollow cylindrical shaped rotary body and an inner surface of the fixed hollow cylindrical body for providing the polishing solution.

17. The polishing machine for a peripheral edge of a semiconductor wafer according to claim 14, wherein the hollow cylindrical shaped rotary body comprises n-polar and s-polar magnets alternatively arranged on its inner surface.

* * * * *